United States Patent [19]

Schwarzkopf

[11] 4,361,094

[45] Nov. 30, 1982

[54] DRIVE MEMBER FOR RAIL-TYPE AMUSEMENT-RIDE CAR

[75] Inventor: Anton Schwarzkopf, Münsterhausen, Fed. Rep. of Germany

[73] Assignee: Firma Anton Schwarzkopf Stahl- und Fahrzeugbau, Münsterhausen, Fed. Rep. of Germany

[21] Appl. No.: 244,956

[22] Filed: Mar. 18, 1981

[30] Foreign Application Priority Data

Nov. 14, 1980 [DE] Fed. Rep. of Germany ..... 3043071

[51] Int. Cl.[3] ..... B61B 13/000

[52] U.S. Cl. ..... 104/168; 104/53; 104/63; 104/172 R; 198/835; 273/86 F

[58] Field of Search ..... 104/168, 162, 163, 165, 104/172 R, 172 B, 172 BT, 172 C, 172 S, 173 R, 189, 56, 58, 66; 198/835, 834; 46/260; 273/86 F

[56] References Cited

U.S. PATENT DOCUMENTS 3,211,279 10/1965 Smith ..... 198/833 X
3,338,380 8/1967 Grebe ..... 198/835 X
3,403,633 10/1968 Schwarzkopf ..... 104/68

FOREIGN PATENT DOCUMENTS 55-130403 10/1980 Japan ..... 198/83 J
364513 2/1973 U.S.S.R. ..... 198/835

*Primary Examiner*—Joseph F. Peters, Jr.
*Assistant Examiner*—M. J. Hill
*Attorney, Agent, or Firm*—Karl F. Ross

[57] ABSTRACT

An amusement ride has rails defining a longitudinal travel direction along which a car is displaceable. A longitudinally extending drive member secured to this car is engageable by drive members which rotate to displace the car along the rails in the longitudinal direction. This member comprises at least two generally parallel, longitudinally extending, and vertically spaced chains each formed of a longitudinal succession of links and a plurality of longitudinally succeeding rigid segments each having a pair of transversely bolted-together halves flanking the chains. The halves of each segment are complementarily formed to and encase a respective plurality of the chain links.

15 Claims, 9 Drawing Figures

DRIVE MEMBER FOR RAIL-TYPE AMUSEMENT-RIDE CAR

FIELD OF THE INVENTION

The present invention relates to a rail-type amusement ride. More particularly this invention concerns a drive member for the car of such a ride.

BACKGROUND OF THE INVENTION

It is known, as for example from my U.S. Pat. No. 3,403,633, to provide the underside of an amusement-ride car of the rail type with a drive member that constitutes a bar extending longitudinally in the transport direction. This bar is engaged transversely on both sides by oppositely effective drive rollers that are driven to impart motion to the car and other cars attached to it. Such an arrangement is used in rail-type rides of the roller-coaster type.

The drive member must be able to transmit considerable longitudinal forces from the drive wheels that engage it to the car it is carried by. Accordingly this drive member is normally made very rigid and, in fact, is frequently constituted as a downwardly projecting sort of ventral rib on the car. As the car moves above the drive rollers these rollers grip the drive member and push it and the car along.

It is necessary that the drive member remain centered between the drive rollers. Accordingly in an arrangement having a curved track it is standard practice to form the drive member of the same radius of curvature as the track, so that it remains centered between the drive rollers. Similarly when used in a straight section of track the drive member is normally perfectly straight.

The disadvantage of these systems is that minor maladjustments of the drive rollers or of the drive member frequently result in only one of the drive rollers engaging the drive member so that insufficient force can be transmitted to the car. Similarly it is frequently necessary to provide several driving stations along a single track. When this is done it is essential that they all be placed in a track portion of the same curvature, or all in straight sections. It is impossible with the prior-art drive member to provide some drive-roller sets in curves and others in straight sections due to the drive-member configuration.

OBJECTS OF THE INVENTION

It is therefore an object of the present invention to provide an improved drive member for a car of a rail-type amusement ride.

Another object is to provide such a drive member which effectively transmits longitudinal force, both in tension and compression, to the car provided with it.

Another object is to provide such a drive member which can easily coact with drive rollers provided at virtually any location along a track having straight and curved sections.

Yet another object is to provide such a drive member which automatically perfectly aligns itself between the drive rollers.

SUMMARY OF THE INVENTION

These objects are attained according to the instant invention by making the drive member limitedly laterally flexible. This drive member is therefore attached at its leading and trailing ends to the car to be driven, but is movable horizontally transversely relative to the car to an at least limited extent so that it can automatically align itself between rollers whether in a straight track section or in a curved track section. Moreover the drive member can automatically move from one side to the other so as automatically to perfectly center itself between the drive rollers.

More particularly according to the instant invention the drive member is constituted as at least two generally parallel, longitudinally extending, and vertically spaced chains each formed of a longitudinal succession of links, and of a plurality of longitudinally succeeding rigid segments each having a pair of transversely engaging halves flanking the chains. The halves of each segment are complementarily formed to and encase a respective plurality of the links of the chains. Means such as bolts is provided for securing one half of each segment to the other respective half of the segment for gripping the respective plurality of links.

Thus in accordance with the instant invention the drive member, which is attached according to this invention at vertical pivot pins at its leading and trailing ends, can be deflected considerably laterally between its ends, yet will nonetheless serve to transmit longitudinal forces both in compression and in tension. The segments have outer surfaces, normally roughened so as to increase the hold of the drive rollers on them, which can be flatly engaged by these drive rollers for excellent force transmission between them and the drive member. Force is transmitted from segment to segment by the chain links joining them.

As mentioned above according to this invention end segments are provided for connection to ends of the car provided with the drive member. These end segments are mounted on coupling parts about vertical pivot pins. Furthermore one of the coupling parts is limitedly displaceable in the travel direction of the car, but is urged by springs into a central position from which it can move both forwardly and backwardly to an at least limited extent. To this end the coupling part is guided in the travel direction with a pin extending in the travel direction and provided on both sides with spring or belleville washers.

According to further features of this invention at least some of the segments, normally the central segments, are spaced longitudinally slightly apart and are formed with cavities around the respective chain links. These cavities and the spaces between the segments are filled with an elastomeric mass. Complete filling of the cavities is insured by providing sprue or vent holes which allow air captured in these cavities to be driven out as the rubber mass is poured in, and which eventually are themselves filled with the mass. Such a system insures an excellent elastic encasing of the chain links in the segments, and excellent force transmission between adjacent segments. At the same time the drive is made to operate relatively quietly by use of this elastomeric mass. Normally the chains are stretched tight before the elastomeric mass is cast through the drive member. Thus the chains are pulled tight and the drive member is laid in the lower half of a mold. The upper half of the mold is then closed over it and the elastomeric mass is injected into the mold. This elastomeric mass urges the drive member into a longitudinal straight position.

The longitudinally directed ends of the segments do not meet in plane or surface contact with each other, but meet at most in line contact. According to this invention they meet along a vertical line, and each end surface is longitudinally convex. Thus lateral deflection is relatively easy for the drive member according to this invention. It is also possible for it to be deflected upwardly and downwardly according to this invention.

According to another feature of this invention the upper edge and upper chain of the drive member are straight and the lower edge and chain are downwardly convex, normally following a catenary. An intermediate chain follows an intermediate catenary. Thus the drive member is relatively robust and can transmit considerable forces.

SPECIFIC DESCRIPTION

Figure 1:
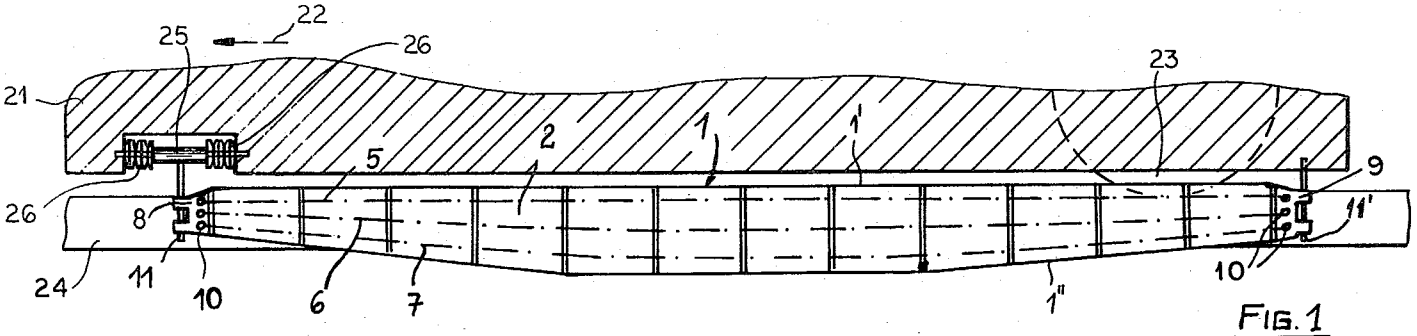
FIG. 1 is a side view partly in vertical section through a car equipped with the drive member according to the instant invention.

As shown in FIG. 1 an amusement-ride car 21 displaceable in a direction 22 is carried by means of wheels 23 on rails 24. This car 21 is provided midway between its wheels 23 with a longitudinally extending drive member 1 constituted as a longitudinal succession of segments 2 each formed by a pair of segment halves 3 and 4. As shown in dot-dash lines in FIG. 1 and solid lines in FIGS. 7–9, a staight upper chain 5, a catenary intermediate chain 6, and a catenary lower chain 7 extend through and interconnect the links 3 and 4.

The drive member 1 has a leading-end segment 8 and a trailing-end segment 9 each provided with three horizontally extending and vertically spaced shear-resistant pins 10 over which the end links of the chains 5–7 are engaged and permanently bolted in place. The trailing segment 9 is pivotal about a vertical axis on a vertical pivot pin 11' seated in the trailing end of the car 21. The leading end 8 is similarly carried on a vertical pivot pin 11, but this is carried on a horizontal pin 25 urged into a central position by means of belleville washers 26. The springs 26 are tensioned so that they hold the upper chain 5 normally perfectly straight, so as to keep the upper edge 1' of the member 1 straight. The lower edge 1'' is downwardly convex and generally follows the catenary of the lower chain 7.

Figure 2:
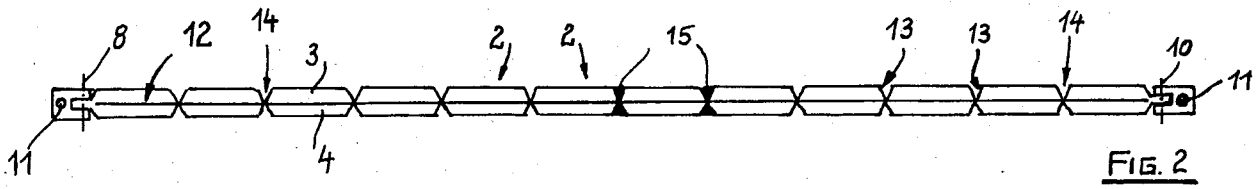
FIG. 2 is a top view of the drive member of FIG. 1.

As better shown in FIG. 2 the drive member 1 is symmetrical about a vertical symmetry plane 12 at which the segment halves 3 and 4 meet. In addition each segment 2 has a longitudinally convex end surface 13 that meets the corresponding end surface 13 of the adjacent segment 2 in line contact at most. This forms spaces 14 between adjacent segments 2.

According to the instant invention an elastomeric mass 15 is cast into these spaces 14 and, as will be described below, into any cavities formed between two segment halves 3 and 4.

Figure 3:
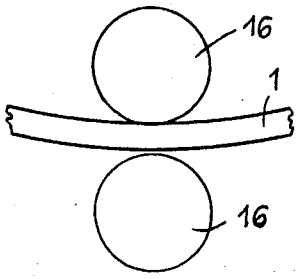
FIGS. 3 and 4 are top views showing how the system of FIG. 1 works.
Figure 4:
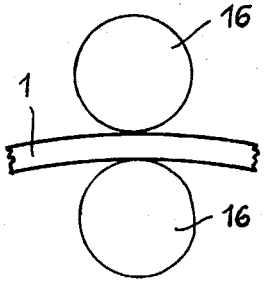
Figure 5:
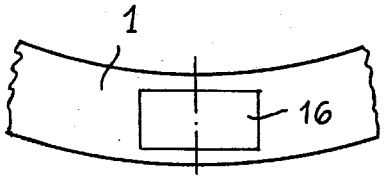
FIGS. 5 and 6 are side views showing further how the drive member according to the instant invention functions.
Figure 6:
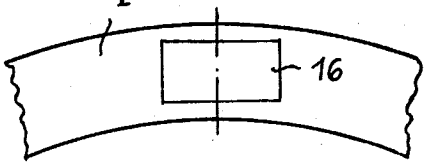

FIGS. 3 and 4 show how even if the member 1 is curved to one side or the other drive wheels or rollers can engage them and transmit longitudinal force through the drive member 1 to the car 21. Even if the member 1 is bent upwardly or downwardly as shown in FIGS. 5 and 6, respectively, the drive rollers 16 will be able to engage them and transmit force to them.

Figure 8:
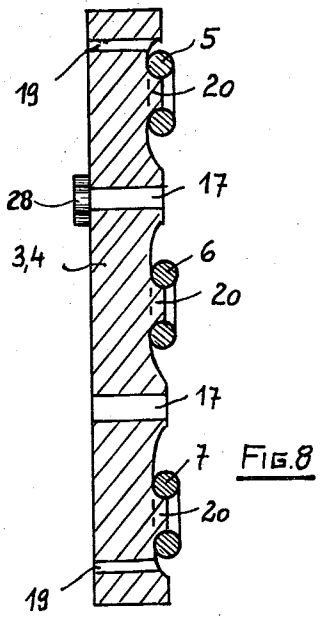
FIGS. 8 and 9 are sections taken respectively along lines VIII—VIII and IX—IX of FIG. 7.
Figure 7:
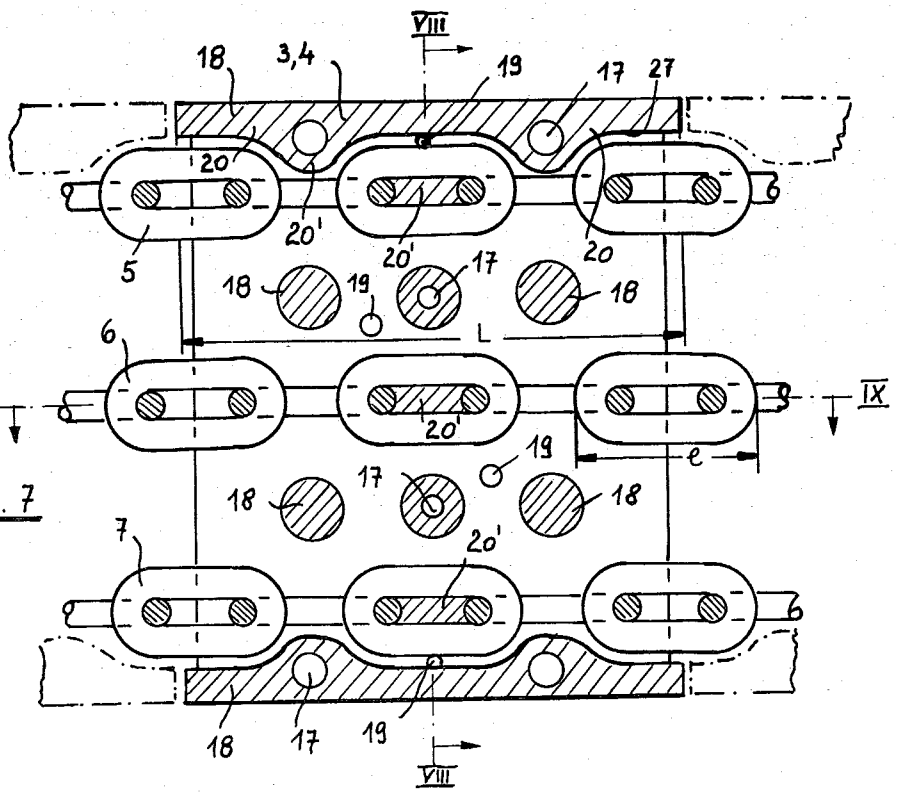
FIG. 7 is a large-scale vertical section through a segment of the drive member according to this invention.
Figure 9:
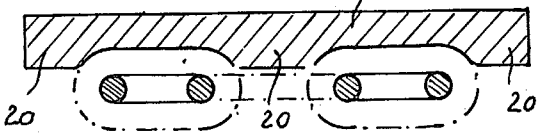

As best shown in FIGS. 7–9 each of the segment halves 3 and 4 is formed with a plurality of bumps or bosses 20 forming concavities 27 that complementarily receive the links of the chains 5–7. The longitudinal dimension L of each link 2 is therefore approximately equal to the longitudinal length l of four chain links. Thus three of the chain links are captured inside each segment 2, and halves of two further links project outwardly from each segment 2. Bolt holes 17 are formed through these segment halves so that they can be bolted together. These bolt holes 17 are provided at planar surfaces 18 of the bumps 20 that are complementarily shaped to fit around the links of the chains 5–7. These planar surfaces 18 engage each other flatly when two segment halves 3 and 4 are bolted together to make each segment 2 an extremely rigid structure. In addition at least some of the raised portions or bosses 20' fit exactly within links of the chains 5–7 to lock them longitudinally tightly in place and insure perfect spacing of these chains 5–7.

Sprue or vent holes 19 are provided so that the cavity formed between two segment halves 3 and 4 can be completely filled without voids by the elastomeric mass 15. This is normally done by laying a drive member held together by bolts shown at 28 in FIG. 8 in one half of a mold and then closing the other half of the mold down over the drive member while maintaining the chain 5 under good tension and perfectly straight. The entire mass 15 is then cast in and around the drive member 1 so as to form it into a flexible but longitudinally incompressible and inextensible drive member.

The segment halves 3 and 4 are made of chill-cast aluminum coated with bronze and having roughened outer surfaces. Thus the drive rollers 16 can gain a good purchase on the segments 2 for excellent force transmission to the car 21 carrying the drive member 1 formed by them.

I claim:

1. In an amusement ride comprising:

rails defining a longitudinal travel direction;

a car displaceable along said rails in said longitudinal direction;

a longitudinally extending drive member having ends secured to said car; and drive rollers transversely engageable with said member for displacing said car along said rails in said direction; the improvement wherein said member comprises:

at least two generally parallel, longitudinally extending and vertically spaced chains each formed of a longitudinal succession of links;

means connected between at least one of said ends and said car for longitudinally tensioning said chains between said ends;

a plurality of longitudinally succeeding rigid segments having respective pairs of transversely engaging halves flanking said chains, the halves of each segment being complementarily formed to and encasing a respective plurality of said links; and means for securing one half of each segment transversely to the other respective half for gripping the respective plurality of links.

2. The improvement defined in claim 1 wherein said halves form cavities between themselves and said segments are spaced slightly apart longitudinally, said improvement further comprising an elastic and elastomeric mass filling said cavities between said halves and the longitudinal spaces between said segments.

3. The improvement defined in claim 2 wherein said halves are each formed with sprue vent holes filled by said mass.

4. The improvement defined in claim 2 wherein each of said halves is formed with a plurality of planar surfaces flatly engaging the planar surfaces of the other respective half.

5. The improvement defined in claim 4 wherein each of said halves is formed with a plurality of recesses complementarily receiving the respective chain links.

6. The improvement defined in claim 1 wherein said plurality of segments includes a pair of opposite end segments provided with shear-resistant pins passing through the endmost links of said chains.

7. The improvement defined in claim 1 wherein said car is provided at each end of said member with a vertical pivot pin, said plurality of segments including a pair of opposite end segments pivoted on the respective pivot pins.

8. The improvement defined in claim 7 wherein one of said pins is limitedly elastically displaceable in said direction.

9. The improvement defined in claim 8 wherein said means for tensioning includes two oppositely longitudinally effective springs braced against said one pin.

10. The improvement defined in claim 1 wherein said member has a generally straight upper edge and a downwardly convex lower edge.

11. The improvement defined in claim 1 wherein said segments have longitudinally directed convex end surfaces.

12. The improvement defined in claim 1 wherein each of said segments is coated with bronze.

13. The improvement defined in claim 1 wherein each of said segments has a roughened outer surface.

14. The improvement defined in claim 1 wherein each of said segments is of hard cast aluminum.

15. The improvement defined in claim 1 wherein each of said segments has a longitudinally directed end having a vertically straight edge and seen from above an outwardly convex shape, whereby said member can flex transversely.

* * * * *